US007550922B2

(12) United States Patent
Ahn

(10) Patent No.: US 7,550,922 B2
(45) Date of Patent: Jun. 23, 2009

(54) PLASMA DISPLAY PANEL

(75) Inventor: Sungyong Ahn, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 343 days.

(21) Appl. No.: 11/620,376

(22) Filed: Jan. 5, 2007

(65) Prior Publication Data

US 2007/0152581 A1 Jul. 5, 2007

(30) Foreign Application Priority Data

Jan. 5, 2006 (KR) ..... 10-2006-0001250

(51) Int. Cl.
*H01J 17/49* (2006.01)

(52) U.S. Cl. ..... 313/582; 313/584

(58) Field of Classification Search ..... 313/582, 313/584

See application file for complete search history.

(56) References Cited

U.S. PATENT DOCUMENTS

2002/0175623 A1* 11/2002 Kim et al. ..... 313/585

FOREIGN PATENT DOCUMENTS

KR 1019990076411 10/1999

OTHER PUBLICATIONS

Korean Office Action from Application No. 10-2006-0001250 dated Jun. 26, 2007 with English translation (3 pages).

* cited by examiner

*Primary Examiner*—Vip Patel
(74) *Attorney, Agent, or Firm*—Fish & Richardson P.C.

(57) ABSTRACT

A plasma display panel is provided. The plasma display panel includes a front substrate and a rear substrate adjoined together with a given distance therebetween, a barrier rib partitioning discharge spaces and non-discharge spaces between the front substrate and the rear substrate, and a black layer shielding the non-discharge spaces. A ratio of the area of the discharge spaces to the area of the discharge cells ranges from about 0.45 to about 0.59.

20 Claims, 8 Drawing Sheets

$W_2 > W_3$

PLASMA DISPLAY PANEL

CROSS-REFERENCE

This nonprovisional application claims priority under 35 U.S.C. §119(a) on Patent Application No. 10-2006-0001250 filed in Korea on Jan. 5, 2006, the entire contents of which are incorporated herein by reference.

BACKGROUND

1. Field

The present invention relates to a plasma display panel.

2. Description of the Background Art

In general, a plasma display panel includes a phosphor layer within discharge cells partitioned by barrier ribs, and a plurality of electrodes supplied a driving signal to generate a discharge within the discharge cells.

In such a plasma display panel, when a driver supplies the driving signal to the plurality of electrodes, vacuum ultraviolet rays are produced due to a discharge gas filled into the discharge cells. The vacuum ultraviolet rays cause phosphors within the discharge cells to emit light, thereby implementing an image.

SUMMARY

Accordingly, embodiments of the present invention provide a plasma display panel advantageous of improving discharge efficiency and a contrast characteristic by reducing external light reflectivity of the plasma display panel.

In one aspect, a plasma display panel includes a front substrate, a rear substrate, a first barrier rib, a second barrier rib and a black layer, the first substrate and the rear substrate adjoined together with a given distance therebetween, the first barrier rib formed between the front substrate and the rear substrate in a first direction, the second barrier rib formed in a second direction intersecting with the first direction, the black layer formed over the front substrate corresponding to the first barrier rib, wherein the first barrier rib and the second barrier rib define a unit discharge cell and a unit discharge space, and a ratio of the area of the unit discharge space to the area of the unit discharge cell ranges from about 0.45 to about 0.59.

In another aspect, a plasma display panel includes a front substrate and a rear substrate adjoined together with a given distance therebetween, a first barrier rib and a second barrier rib, the first barrier rib formed between the front substrate and the rear substrate in a first direction, the second barrier rib formed in a second direction intersecting with the first direction, a black layer formed over the front substrate corresponding to the first barrier rib, wherein the first barrier rib and the second barrier rib define a plurality of discharge cells and a plurality of discharge spaces, and a ratio of the total area of the discharge spaces to the total area of the discharge cells ranges from about 0.45 to about 0.59 in an effective region on which an image is displayed.

In still another aspect, a plasma display panel includes a front substrate and a rear substrate adjoined together with a given- distance therebetween, a first barrier rib and a second barrier rib, the first barrier rib formed between the front substrate and the rear substrate in a first direction, the second barrier rib formed in a second direction intersecting with the first direction, a black layer formed over the front substrate corresponding to the first barrier rib, wherein a width of a top portion of the first barrier rib is three to five times larger than a width of a top portion of the second barrier rib, the first barrier rib and the second barrier rib define a unit discharge cell and a unit discharge space, and a ratio of the area of the unit discharge space to the area of the unit discharge cell ranges from about 0.45 to about 0.59.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like numerals refer to like elements.

DETAILED DESCRIPTION OF EMBODIMENTS

The invention will be described in detail with reference to the following drawings in which like numerals refer to like elements.

Figure 1:
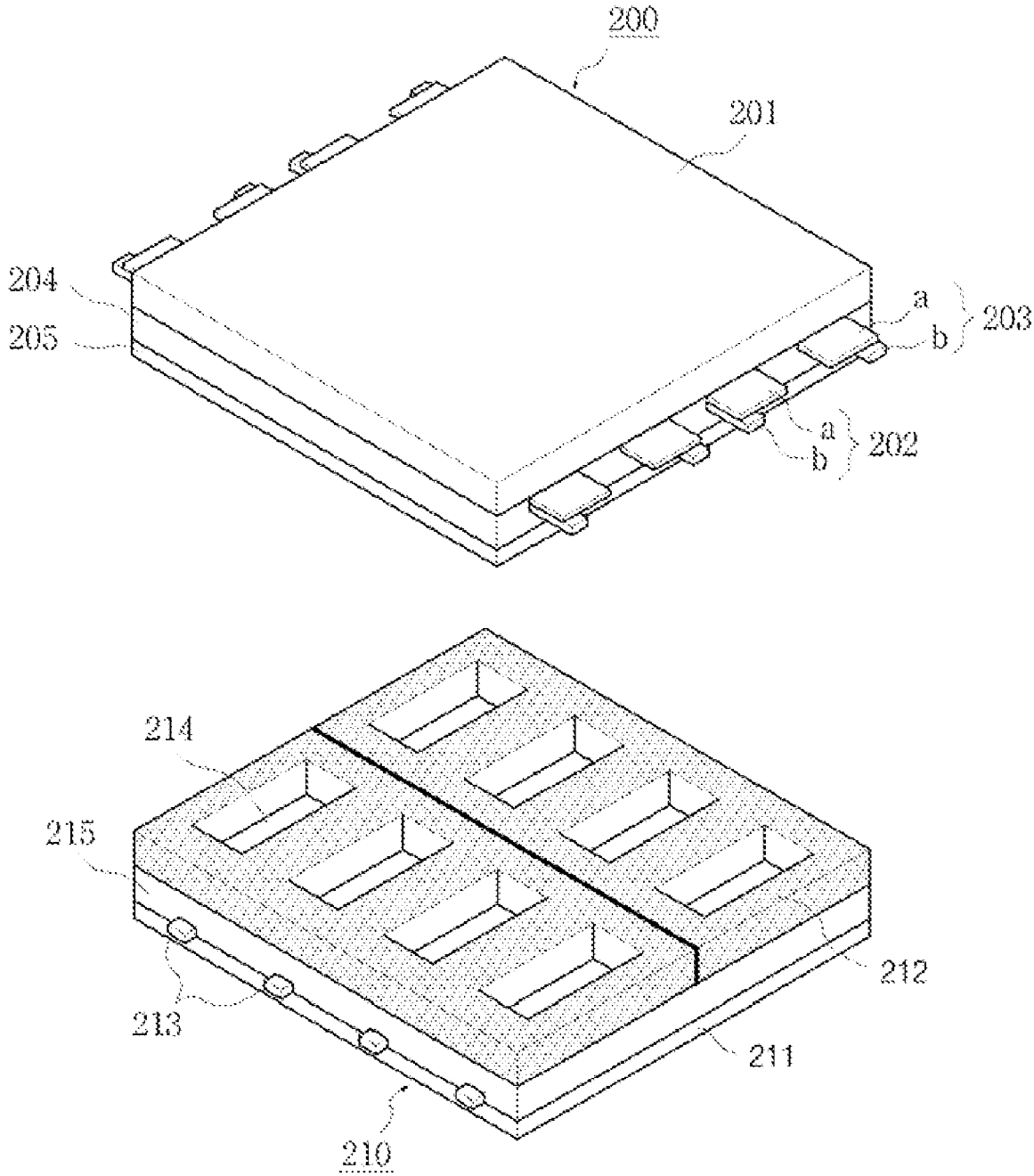
FIG. 1 illustrates a plasma display panel structure according to an embodiment of the present invention.

FIG. 1 illustrates a plasma display panel structure according to an embodiment of the present invention.

In the plasma display panel illustrated in FIG. 1, a front panel 200 and a rear panel 210 are adjoined together to run parallel with a given distance therebetween. The front panel 200 comprises a front substrate 21 on which an image is displayed, and scan electrodes 202 and sustain electrodes 203, which are formed on the front substrate 201. The rear panel 210 comprises a rear substrate 211, and address electrodes 213 arranged to intersect with the scan electrodes 202 and the sustain electrodes 203.

Each of the scan electrodes 202 and the sustain electrodes 203 formed on the front substrate 201 comprises a transparent electrode 'a' and a bus electrode 'b'. The transparent electrodes 'a' and the bus electrodes 'b' are formed of an indium-tin-oxide (ITO)-based material and a non-transparent metal-based material, respectively.

An upper dielectric layer 204 is formed on the front substrate 201 where the scan electrodes 202 and the sustain electrodes 203 are formed. The upper dielectric layer 204 limits discharge current of the scan electrodes 202 and the sustain electrodes 203, and insulates the scan electrodes 202 and the sustain electrodes 203 from each other.

A protection layer 205 is formed on the upper dielectric layer 204 to provide a readily discharging condition. The protection layer 205 is formed by depositing magnesium oxide (MgO) on the upper dielectric layer 204.

A lower dielectric layer 215 is formed on the rear substrate 211 where the address electrodes 213 are formed. The lower dielectric layer 215 insulates the address electrodes 213 from each other.

Barrier ribs 212 are formed on the lower dielectric layer 215 to partition discharge cells.

In such a case, the discharge cells partitioned by the barrier ribs 212 may be formed in a stripe-type, well-type, a delta-type, or a honeycomb-type structure.

Phosphor materials 214 are formed within the discharge cells partitioned by the barrier ribs 212 to represent colors including red (R), green (G) and blue (B). In addition to the R, G, and B discharge cells, phosphor materials for representing white W or yellow Y may be formed within the discharge cells.

Although FIG. 1 illustrates one exemplary plasma display panel according to an embodiment of the present invention, it should be noted that the plasma display panel structure is not limited to the illustrated exemplary structure. For instance, although the upper dielectric layer 204 and the lower dielectric layer 205 in the present embodiment are illustrated in a single layer structure, the upper dielectric layer 204 and the lower dielectric layer 205 may be formed in a multiple layer structure.

Also, it is illustrated in the present embodiment that the front panel 200 comprises only the scan electrodes 202 and the sustain electrodes 203, and the rear panel 210 comprises only the address electrodes 213. However, the scan electrodes 202, the sustain electrodes 203, and the address electrodes 213 may be formed on the front panel 200. Alternatively, one of the scan electrodes 202, the sustain electrodes 203, and the address electrodes 203 may be formed on the barrier ribs 212.

The scan electrodes 202 and the sustain electrodes 203 may comprise merely the bus electrodes 'b' without the transparent electrodes 'a'.

Figure 2A:
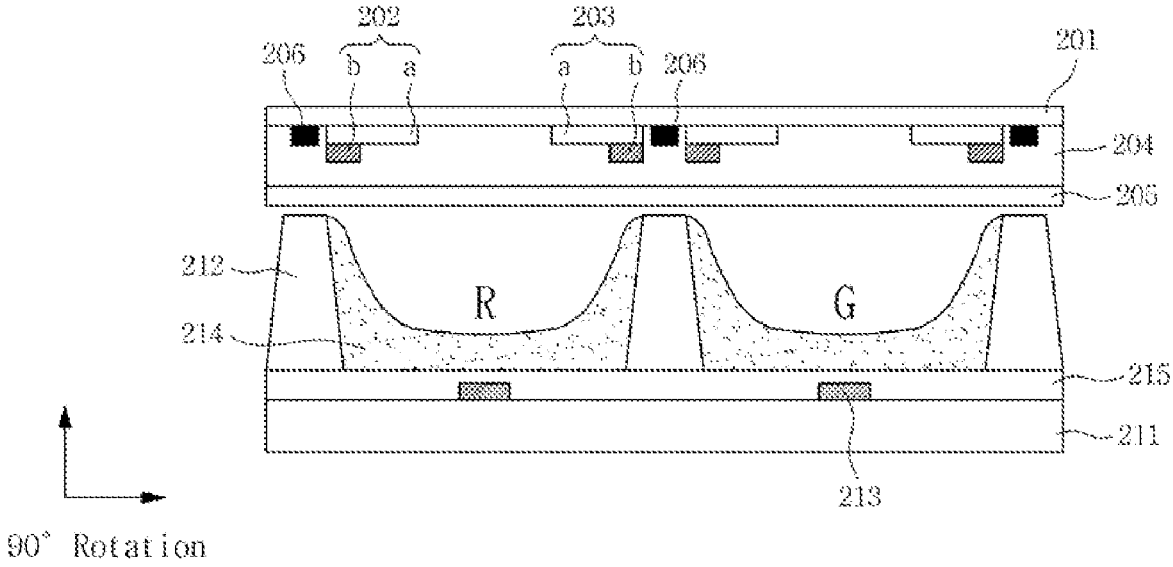
FIGS. 2*a* to 2*c* illustrate sectional views of a plasma display panel comprising black layers positioned in non-discharge spaces according to an embodiment of the present invention.
Figure 2B:
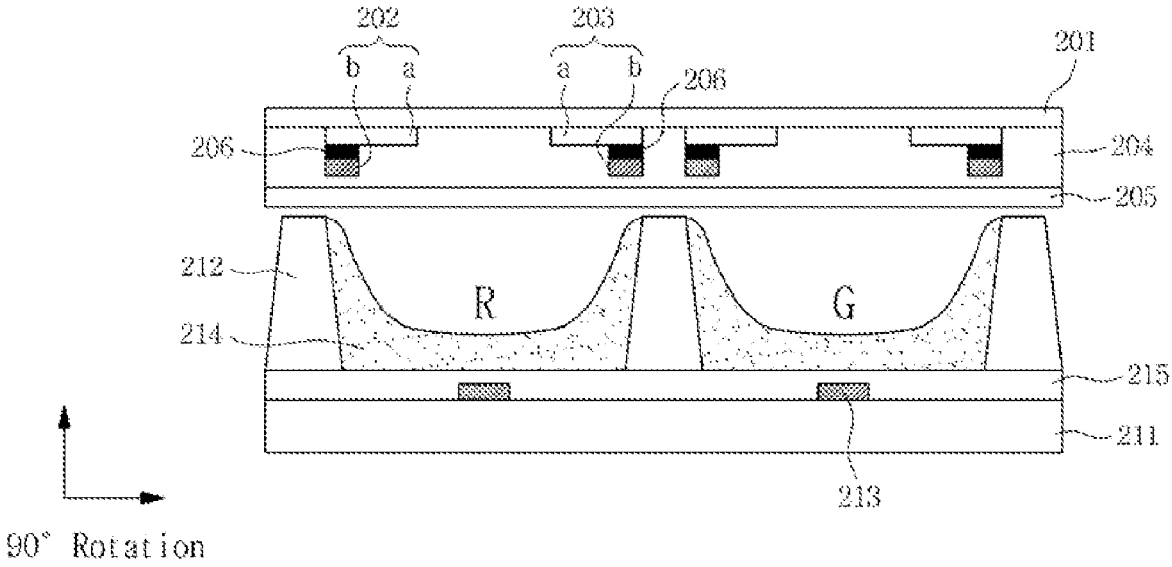
Figure 2C:
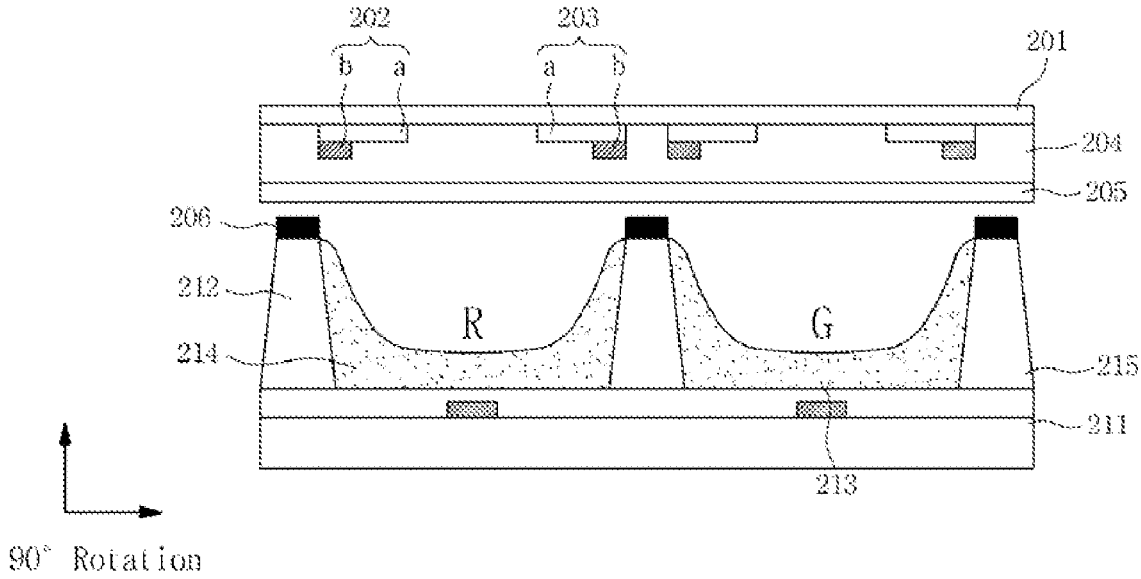

FIGS. 2*a* to 2*c* illustrate sectional views of a plasma display panel comprising black layers according to various embodiments of the present invention.

Referring to FIG. 2*a*, the black layers 206 are formed on regions of a front substrate 201 corresponding to barrier ribs 212 formed over a rear substrate 211. The black layers 206 are formed on the same surface of the front substrate 201 where scan electrodes 202 and sustain electrodes 203 are formed.

The black layers 206 may be formed inside an upper dielectric layer 204. In this case, although not illustrated, the upper dielectric layer 204 comprises a first upper dielectric layer and a second upper dielectric layer. The black layers 206 are formed to cover the scan electrodes 203 and the sustain electrodes 203, and formed in regions corresponding to barrier ribs 212 formed over the first upper dielectric layer. The second upper dielectric layer is formed on the first upper dielectric layer to cover the black layers 206.

Referring to FIG. 2*b*, the black layers 206 each are formed between a transparent electrode 'a' and a bus electrode 'b' for use in the scan electrodes 202 and the sustain electrodes 203. In this case, the black layers 206 are formed of a conductive material in order to make the transparent electrodes 'a' and the bus electrodes 'b' electrically coupled to each other. Also, the black layers 206 may be formed to integrate with the bus electrodes 'b' formed on the front substrate 201.

Referring to FIG. 2*c*, the black layers 206 are formed on the barrier ribs 212. The black layers 206 are formed to integrate with the barrier ribs 212.

The black layers 206 of the plasma display panel according to the present embodiment are formed in regions corresponding to the barrier ribs 212 formed over the rear substrate 211.

Figure 3:
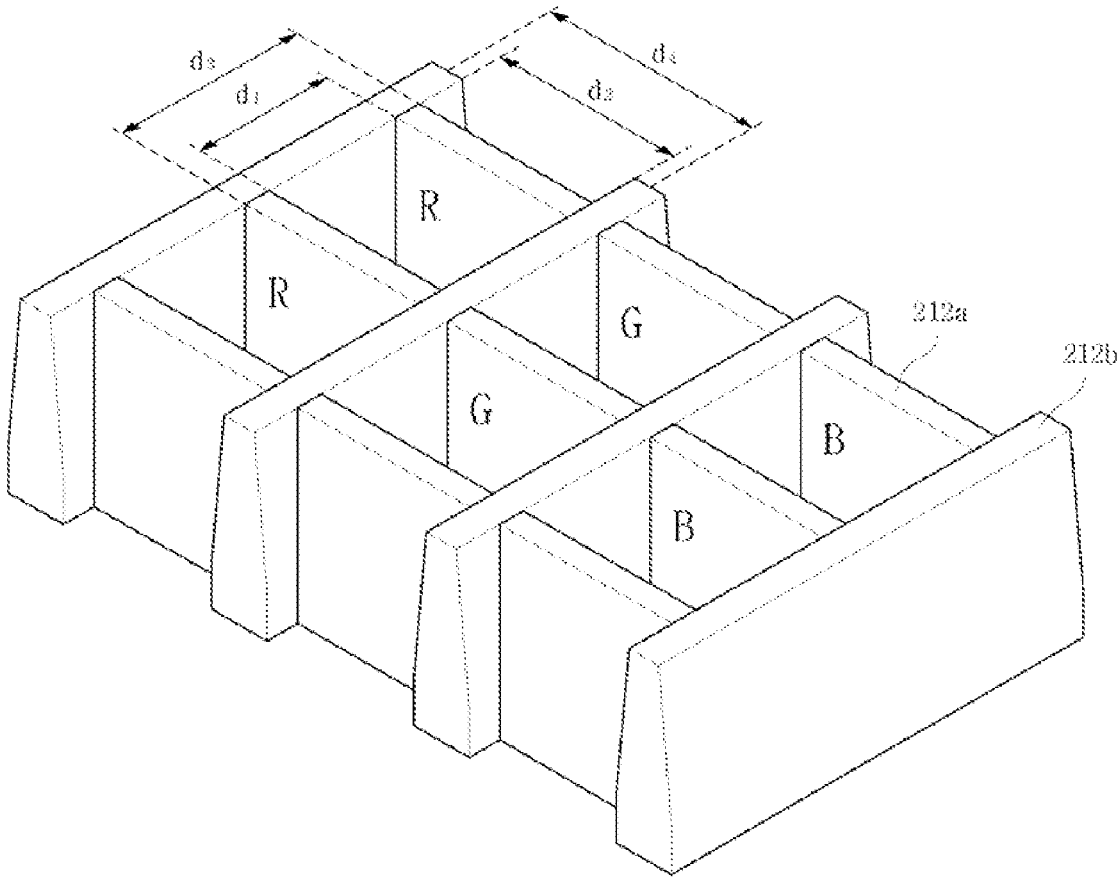
FIG. 3 is a perspective view illustrating a structure of discharge cells of a plasma display panel according to an embodiment of the present invention.

FIG. 3 is a perspective view illustrating a structure of discharge cells of a plasma display panel according to an embodiment of the present invention.

The discharge cells of the plasma display panel are partitioned by barrier ribs. The barrier ribs each comprises a first barrier rib 212*a* and a second barrier rib 212*b*, which intersect with each other and make up one discharge cell. The first barrier ribs 212*a* partition the discharge cells emitting the same color of light. The second barrier ribs 212*b* partition the discharge cells emitting different colors of light. In this case, the area of the unit discharge cell and the area of the unit discharge space in the discharge cells may be defined.

The area of the unit discharge space may be defined as the multiplication of a first distance d1 between top portions of the two neighboring first barrier ribs 212*a* and a second distance d2 between top portions of the two neighboring second barrier ribs 212*b*. The area of the unit discharge cell may be defined as the multiplication of a third distance d3 between central points of the top portions of the first barrier ribs 212*a* and a fourth distance d4 between central points of the top portions of the second barrier ribs 212*b*.

The area of the unit discharge cell may vary depending on the width of the black layers formed in regions corresponding to the barrier ribs. In other words, when a portion of each of the black layers is positioned in a region corresponding to the inner side of the defined unit discharge space, the area of the unit discharge space is a value obtained by subtracting the width of the black layer positioned in the region corresponding to the inner side of the defined unit discharge cell from the area of the defined unit discharge space.

Also, the total area of the discharge cells and the total area of the discharge spaces may be defined in an effective region of the plasma display panel on which an image is displayed.

In other words, the total area of the discharge spaces may be defined by the total addition of the unit discharge spaces, and the total area of the discharge cells may be defined by the total addition of the unit discharge cells.

In such plasma display panel with the above described discharge cell structure, emission efficiency based on a ratio between the area of the unit discharge space and the area of the unit discharge cell may be obtained as in the following exemplary experimental embodiment and FIGS. 4*a* and 4*b*.

Exemplary Experimental Embodiment

| | | | | | |
|---|---|---|---|---|---|
| Width of second barrier rib | 60 μm | 120 μm | 180 μm | 240 μm | 300 μm |
| Width of black layer | 60 μm | 120 μm | 180 μm | 240 μm | 300 μm |
| Area of unit discharge space | 620 × 240 = 149K $\mu m^2$ | 560 × 240 = 134K $\mu m^2$ | 500 × 240 = 120K $\mu m^2$ | 440 × 240 = 106K $\mu m^2$ | 380 × 240 = 91K $\mu m^2$ |
| Area of unit discharge space/Area of unit discharge cell | 149/204 = 0.73 | 134/204 = 0.66 | 120/204 = 0.59 | 106/204 = 0.52 | 91/204 = 0.45 |

-continued

| | | | | | |
|---|---|---|---|---|---|
| Emission efficiency (lm/w) | 1.11 | 1.17 | 1.26 | 1.35 | 1.23 |
| External light reflectivity of plasma display panel (%) | 42.6 | 37.4 | 32.3 | 27.1 | 21.9 |

Figure 4A:
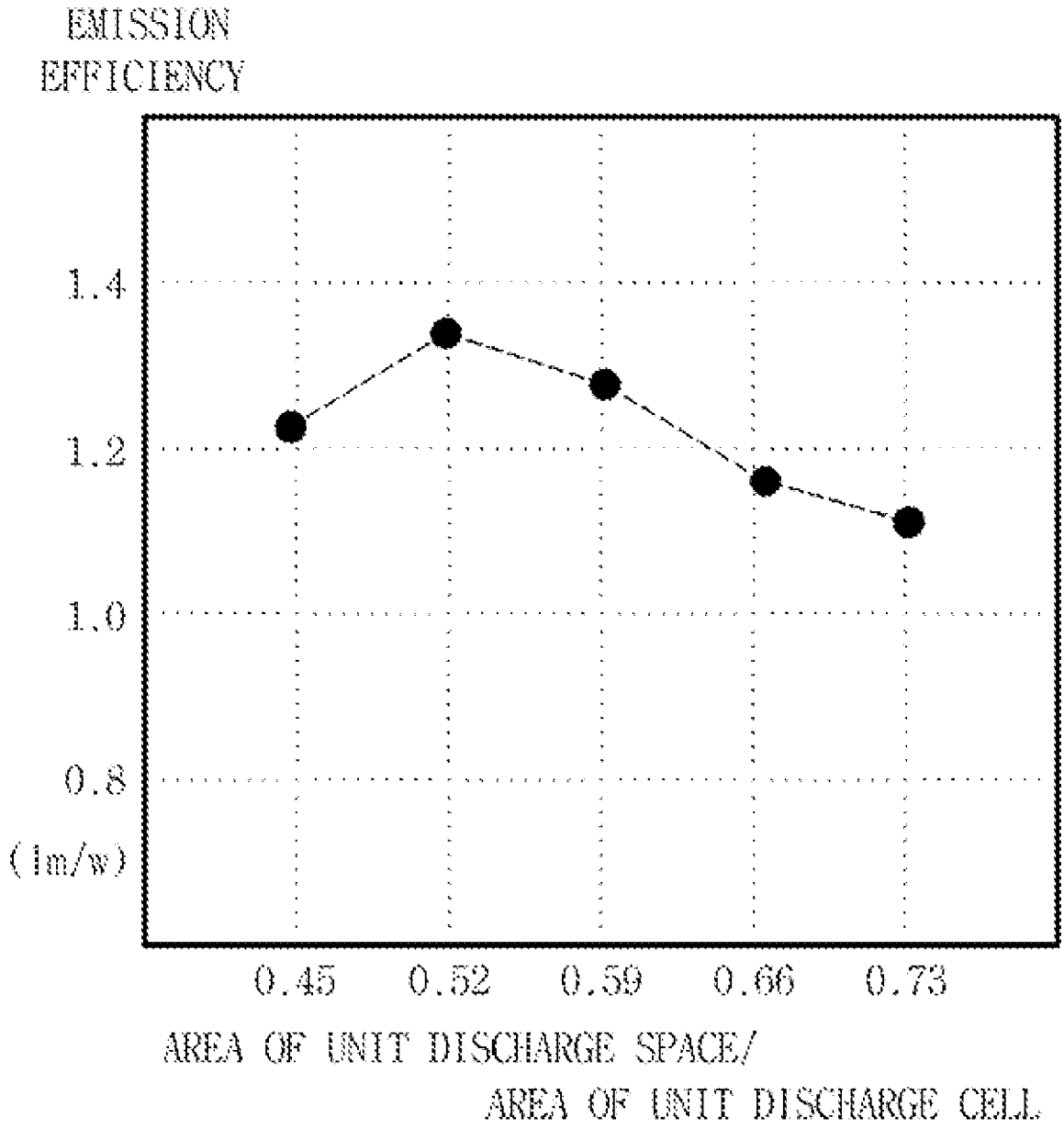
FIG. 4A illustrates a graph of emission efficiency with respect to a ratio of the area of a unit discharge space to the area of a unit discharge cell according to an embodiment of the present invention.
Figure 4B:
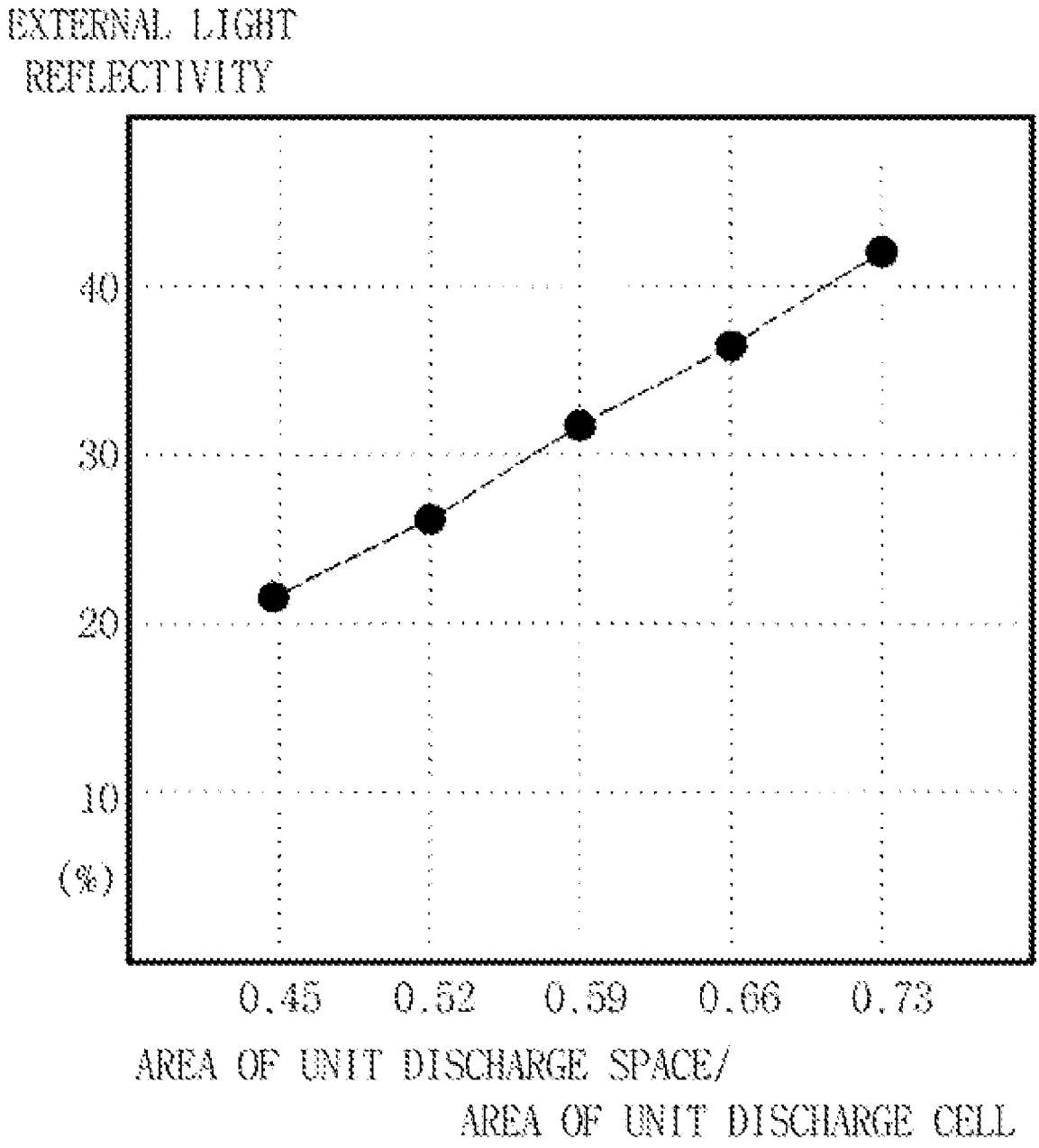
FIG. 4B illustrates a graph of external light reflectivity of a plasma display panel with respect to a ratio of the area of a unit discharge space to the area of a unit discharge cell according to an embodiment of the present invention.

The exemplary experimental embodiment and FIGS. 4*a* to 4*c* show the external light reflectivity of the plasma display panel when the first barrier rib had a fixed width of about 60 μm, and the widths of the second barrier rib and the black layer were changed, thereby changing the area of the unit discharge space. In one embodiment, the area of the unit discharge cell was about 204 K $\mu m^2$, which is the multiplication value of the third distance d3 and the fourth distance d4. The third distance d3 and the fourth distance d4 were about 680 μm and 300 μm, respectively.

As described above, the emission efficiency and external light reflectivity of the plasma display panel increased when the ratio between the area of the unit discharge space and the area of the unit discharge cell was greater than about 0.45 and less than about 0.59.

The emission efficiency and external light reflectivity of the plasma display panel increased when the ratio of the total area of the unit discharge space to the total area of the unit discharge cell was greater than about 0.45 and less than about 0.59.

Figure 5:
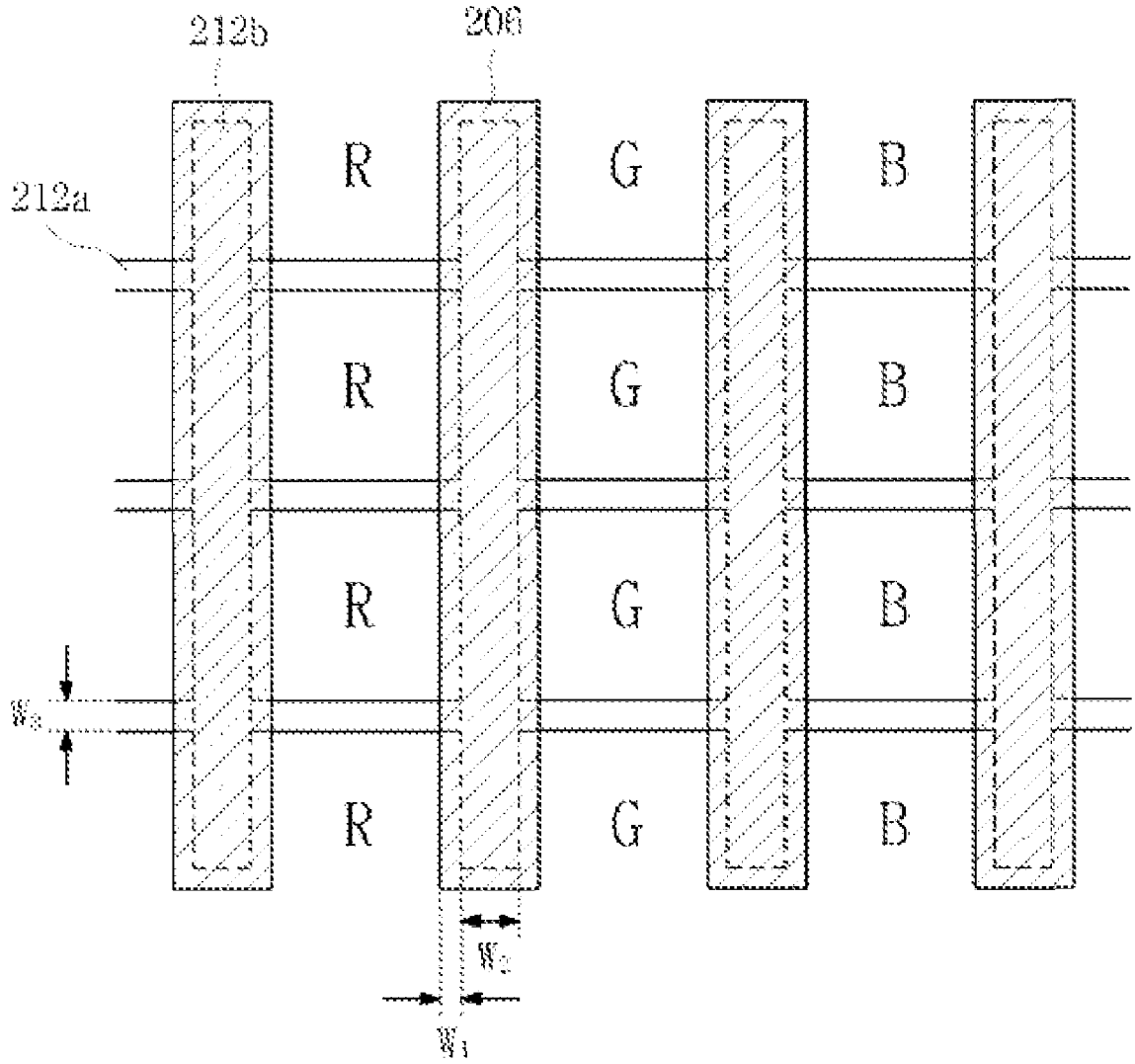
FIG. 5 illustrates a top view of a plasma display panel structure according to an embodiment of the present invention.

As illustrated in FIG. 5, black layers 206 may be formed substantially in the same regions where second barrier ribs 212*b* are formed so as to prevent a decrease in brightness. The black layers 206 may be positioned to correspond to a portion of the inside of the respective unit discharge cell spaces so as to improve a contrast characteristic by absorbing external light.

In this case, the brightness and contrast characteristics are improved when the width w1 of each of the black layers 206 positioned to correspond to the portion of the inside of the unit discharge space is less than the width w2 of a top portion of the corresponding second barrier rib 212*b* by about 0.2-fold.

As described above, the discharge cells comprise red discharge cells, green discharge cells and blue discharge cells. Each of the discharge cells comprises red, green and blue discharge spaces defined by the top portions of the barrier ribs. At least one of the red, green and blue discharge spaces may have the width different from the widths of the rest discharge spaces. In detail, the green discharge spaces or the blue discharge spaces may be wider than the red discharge spaces.

The above described discharge space structure may be obtained according to a change in the width of the second barrier ribs partitioning the unit discharge cells, which emit different colors of light. More specifically, the width w2 of the top portion of each of the second barrier rib 212*b* may vary within in a range of about 3-fold to 5-fold greater than the width w3 of the top portion of each of the first barrier ribs 212*a*.

The variation in the area of each discharge space contributes to improvement in color temperature of the plasma display panel.

Figure 6A:
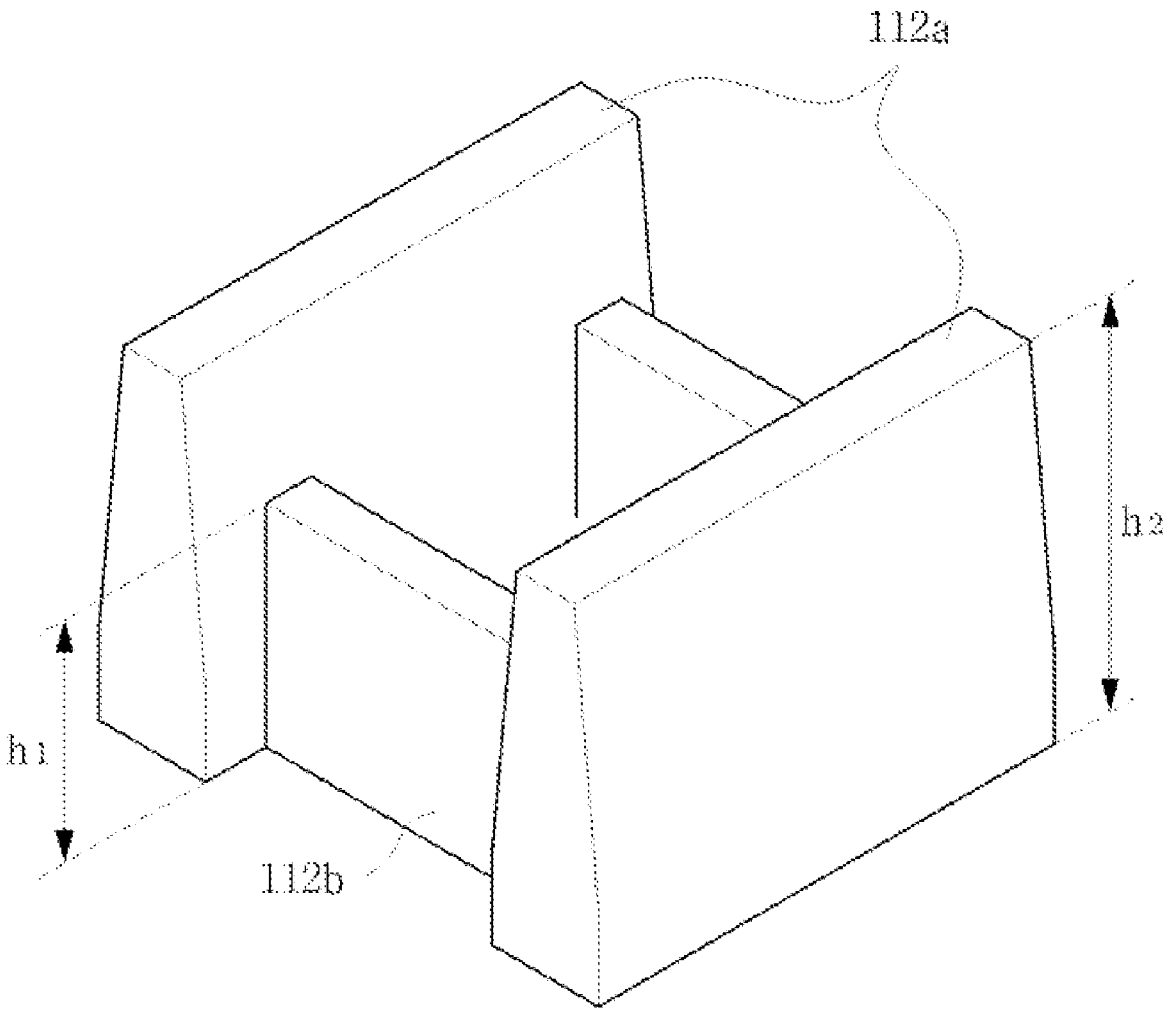
FIGS. 6*a* and 6*b* are perspective views illustrating a structure of a barrier rib of a plasma display panel according to an embodiment of the present invention.
Figure 6B:
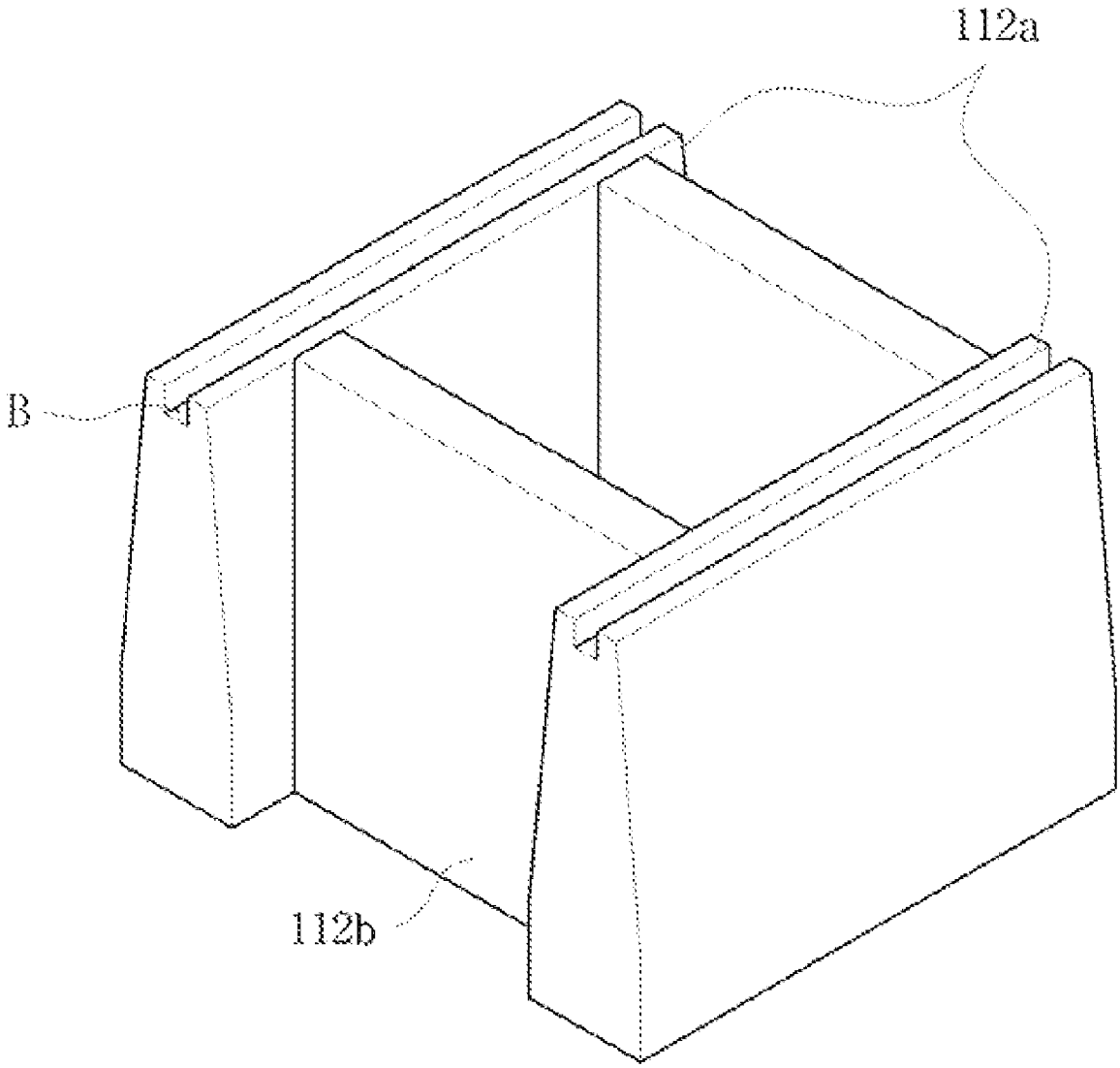

FIGS. 6*a* and 6*b* are perspective views illustrating a structure of a barrier rib of a plasma display panel according to an embodiment of the present invention.

Referring to FIG. 6*a*, the barrier rib 112 comprises first barrier ribs 112*a* and second barrier ribs 112*b*. The height h2 of the first barrier ribs 112*a* is different from the height hi of the second barrier ribs 112*b*. In this case, the first barrier ribs 112*a* higher than the second barrier rib 112*b* partition discharge cells where phosphors with different colors are formed, and the second barrier ribs 112*b* relatively lower than the first barrier ribs 112*a* partition discharge cells where phosphors with the same color are formed.

This barrier rib structure improves an exhaust characteristic during the fabrication of plasma display panels, and prevents an event of color mixing in phosphors, which may occur between neighboring discharge cells when coating the phosphors over the discharge cells.

Referring to FIG. 6*b*, long indentations B are formed lengthwise in top portions of first barrier ribs 112*a* or second barrier ribs 112*b*. This barrier rib structure can improve an exhaust characteristic of a plasma display panel.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel comprising:

a front substrate;

a rear substrate formed in parallel to the front substrate;

a first barrier rib and a second barrier rib, the first barrier rib formed between the front substrate and the rear substrate in a first direction, the second barrier rib formed in a second direction intersecting with the first direction;

a black layer formed in the front substrate corresponding to the first barrier rib, wherein the first barrier rib and the second barrier rib define a unit discharge cell and a unit discharge space, and a ratio of the area of the unit discharge space to the area of the unit discharge cell ranges from about 0.45 to about 0.59.

2. The plasma display panel of claim 1, wherein the area of the unit discharge space is equal to a first distance between top portions of the two neighboring first barrier ribs multiplied by a second distance between top portions of the two neighboring second barrier ribs.

3. The plasma display panel of claim 1, wherein the area of the unit discharge cell is equal to a third distance between central points of top portions of the two neighboring first barrier ribs multiplied by a fourth distance between central points of top portions of the two neighboring second barrier ribs.

4. The plasma display panel of claim 1, wherein the black layer is positioned to correspond to a portion of the inside of the unit discharge space.

5. The plasma display panel of claim 4, wherein a width of the black layers positioned to correspond to the portion of the inside of the unit discharge space is less than 0.2 times the width of the top portion of the second barrier rib.

6. The plasma display panel of claim 1, wherein at least one groove is formed in a top portion of the first barrier rib or the second barrier rib in a direction of length of the first barrier rib or of the second barrier rib.

7. The plasma display panel of claim 1, wherein the black layer is equal to a bus electrode formed over the front substrate.

8. A plasma display panel comprising:

a front substrate;

a rear substrate formed in parallel to the front substrate;

a first barrier rib and a second barrier rib, the first barrier rib formed between the front substrate and the rear substrate in a first direction, the second barrier rib formed in a second direction intersecting with the first direction;

a black layer formed in the front substrate corresponding to the first barrier rib, wherein the first barrier rib and the second barrier rib define a plurality of discharge cells and a plurality of discharge spaces, and a ratio of the total area of the discharge spaces to the total area of the discharge cells ranges from about 0.45 to about 0.59 in an effective region on which an image is displayed.

9. The plasma display panel of claim 8, wherein the discharge spaces comprise a red discharge space, a green discharge space and a blue discharge space, wherein at least one of the red, green and blue discharge spaces has a width different from a width of the remaining discharge spaces.

10. The plasma display panel of claim 9, wherein at least one of the blue discharge space and the green discharge space has a width greater than that of the red discharge space.

11. The plasma display panel of claim 8, wherein the total area of the discharge spaces is obtained by adding the areas of unit discharge spaces together, wherein the area of each of the unit discharge spaces is equal to a first distance between top portions of the two neighboring first barrier ribs multiplied by a second distance between top portions of the two neighboring second barrier ribs.

12. The plasma display panel of claim 8, wherein the total area of the discharge cells is obtained by adding the areas of unit discharge cells together, wherein the area of each of the unit discharge cells is equal to a third distance between central points of top portions of the two neighboring first barrier ribs multiplied by a fourth distance between central points of top portions of the two neighboring second barrier ribs.

13. The plasma display panel of claim 8, wherein the black layer is positioned to correspond to a portion of the inside of the discharge spaces.

14. The plasma display panel of claim 13, wherein a width of the black layers positioned to correspond to the portion of the inside of the unit discharge space is less than 0.2 times the width of the top portion of the second barrier rib.

15. The plasma display panel of claim 8, wherein at least one indentation is formed in a top portion of the first barrier rib or the second barrier rib in a direction of length of the first barrier rib or of the second barrier rib.

16. A plasma display panel comprising:

a front substrate;

a rear substrate formed in parallel to the front substrate;

a first barrier rib and a second barrier rib, the first barrier rib formed between the front substrate and the rear substrate in a first direction, the second barrier rib formed in a second direction intersecting with the first direction;

a black layer formed in the front substrate corresponding to the first barrier rib, wherein a width of a top portion of the first barrier rib is three to five times larger than a width of a top portion of the second barrier rib, the first barrier rib and the second barrier rib define a unit discharge cell and a unit discharge space, and a ratio of the area of the unit discharge space to the area of the unit discharge cell ranges from about 0.45 to about 0.59.

17. The plasma display panel of claim 16, wherein the second barrier rib partitions the unit discharge cells, each discharge cell containing a different phosphor therein, respectively.

18. The plasma display panel of claim 16, wherein the area of the unit discharge space is equal to a first distance between top portions of the two neighboring first barrier ribs multiplied by a second distance between top portions of the two neighboring second barrier ribs.

19. The plasma display panel of claim 16, wherein the area of the unit discharge cell is equal to a third distance between central points of top portions of the two neighboring first barrier ribs multiplied by a fourth distance between central points of top portions of the two neighboring second barrier ribs.

20. The plasma display panel of claim 16, wherein the black layer is positioned to correspond to a portion of the inside of the unit discharge space.

* * * * *